United States Patent [19]

Amani

[11] Patent Number: 4,791,990

[45] Date of Patent: Dec. 20, 1988

[54] LIQUID REMOVAL METHOD SYSTEM AND APPARATUS FOR HYDROCARBON PRODUCING

[76] Inventor: Mahmood Amani, P.O. Box 8584, Wichita, Kans. 67208

[21] Appl. No.: 867,191

[22] Filed: May 27, 1986

[51] Int. Cl.[4] ..... E21B 34/10; E21B 43/12

[52] U.S. Cl. ..... 166/311; 166/372; 166/373; 166/53; 166/322; 166/324; 417/120

[58] Field of Search ..... 166/54.1, 72, 306, 311, 166/313, 374, 386, 387, 324, 325, 332, 305.1, 369–372, 53, 373, 322; 405/53, 59; 251/62; 417/118, 120

[56] References Cited

U.S. PATENT DOCUMENTS

| | | | |
|---|---|---|---|
| 2,942,663 | 6/1960 | Haggard | 166/45 |
| 3,167,125 | 1/1965 | Bryan | 166/306 |
| 3,266,574 | 8/1966 | Gandy | 166/64 |
| 3,277,838 | 10/1966 | Canalizo | 103/232 |
| 3,333,638 | 8/1967 | Bishop | 166/306 |
| 3,362,347 | 1/1968 | Canalizo | 103/233 |
| 3,363,692 | 1/1968 | Bishop | 166/306 |
| 3,741,249 | 6/1973 | Leutwyler | 166/324 |
| 3,980,135 | 9/1976 | Garrett | 166/224 |
| 4,140,153 | 2/1979 | Peaton | 166/324 |
| 4,161,219 | 7/1979 | Pringle | 166/324 |
| 4,201,363 | 5/1980 | Arendt et al. | 251/62 |
| 4,226,284 | 10/1980 | Evans | 166/53 |
| 4,252,197 | 2/1981 | Pringle | 166/324 |
| 4,294,315 | 10/1981 | Yonker et al. | 166/322 |
| 4,376,464 | 3/1983 | Crow | 166/324 |
| 4,378,931 | 4/1983 | Adams, Jr. | 166/332 |
| 4,429,740 | 2/1984 | Malinchak | 166/53 |
| 4,437,514 | 3/1984 | Canalizo | 166/72 |
| 4,452,310 | 6/1984 | Pringle et al. | 166/319 |
| 4,489,786 | 12/1984 | Beck | 166/321 X |

*Primary Examiner*—Stephen J. Novosad
*Assistant Examiner*—Bruce M. Kisliuk
*Attorney, Agent, or Firm*—David A. Rose

[57] ABSTRACT

A method and apparatus are disclosed to detect periodic well loading by produced accumulated secondary fluids, and accordingly to remove the undesired secondary fluid from the tubing of a hydrocarbon producing well. The method according to the present invention employs a surface control system that controls the operation of the fluid removal cycle and the production cycle of the hydrocarbon producing well. Periodically, the well is "shut-in" and a flow control valve, connected to the well tubing, is actuated to block fluid flow from the lower portion of the tubing string, which contains the undesired accumulated secondary fluids. A supply line, having a smaller inner diameter than the internal diameter of the well tubing, is used to inject pressurized gas from the surface of the well into the lower "shut-in" portion of the tubing to provide the necessary pressure to force the accumulated secondary fluids, trapped in the tubing, through a relief valve, and into the annulus of the well casing; thereby removing the undesired secondary fluids from the production tubing. The controller then stops the flow of the injected gas to the supply line to stop the removal cycle and the pressure across the flow control valve is equalized to again begin production.

38 Claims, 9 Drawing Sheets

LIQUID REMOVAL METHOD SYSTEM AND APPARATUS FOR HYDROCARBON PRODUCING

BACKGROUND OF THE INVENTION

This invention relates to method and apparatus to remove the accumulated liquids from hydrocarbon producing wells to improve production. Many hydrocarbon producing wells produce both gas and liquids such as water, oil and condensate. A mixture of these fluids flow from a subsurface formation through casing or tubing to the surface facilities. The liquid is entrained as droplets in the gas flow. Part of the entrained liquid will drop out of the flow due to insufficient velocity of gas. The liquid will accumulate in the bottom of the wellbore, and will ultimately build up to a height to exert a hydrostatic pressure which may be large enough to reduce the production rate or completely stop production. This condition is referred to as "well loading" in this patent application.

It is therefore advantageous to periodically remove part or all of the accumulated liquid from producing wells. By removing the liquid which has accumulated in the well, the hydrostatic pressure exerted by the accumulated liquid against the producing formation pressure will be reduced. Thus the fluid from the formation will enter the wellbore at much higher velocity and the gas will carry the produced liquids to the surface more effectively.

DISCUSSION OF PRIOR ART

In the past, methods have been used to remove the accumulated liquid in the tubing of a hydrocarbon producing well to improve its producing capability. One common method has been to allow liquids to accumulate in a downhole accumulation chamber. The accumulation chamber may be the well tubing string, the annulus, or an accumulation means attached to the well tubing. Periodically the liquid is forced out of the accumulation chamber by gas pressure or formation pressure and is removed from the well. The accumulation chamber is bled off in order to allow it to refill, and the process is repeated. This known method requires a large volume of high pressure gas to displace the undesired liquid from the tubing, therefore making the method inefficient or limiting the method to shallow wells.

U.S. Pat. No. 3,363,692 describes a method in which gas is produced through the casing annulus space upwardly to the sales line. The water rises under pressure of the hydrocarbon producing formation into the tubing. When the hydrostatic pressure of the water column in the tubing overcomes the pressure of the water bearing formation, the liquid is allowed to pass downwardly through a bypass to enter a water bearing formation which is open to the well bore. In another embodiment of the U.S. Pat. No. 3,363,692 hydrocarbon is produced through the annulus and the tubing is used as a liquid accumulation chamber. The tubing is vented to the atmosphere so that the water is able to rise in the tubing to a maximum height. A timed cycle controller at the surface connects the annulus to the tubing to provide additional pressure to force out the water from the tubing for disposal. Methods such as those disclosed in the '692 patent have proven to be ineffective for the following reasons:

1. In many cases the hydrocarbon producing formation pressure is not sufficient to inject liquids into a water bearing formation at a desired rate.

2. A low pressure formation produces more effectively through tubing.

3. Venting natural gas to the atmosphere is wasteful.

U.S. Pat. No. 2,942,663 describes a method in which the accumulated liquid in the tubing is first displaced downwardly by forcing a gas into the top of the well tubing. The forced gas flow is stopped after the liquid level of the accumulated liquid has been lowered only part of the way to the desired depth. Liquid is then forced into the tubing above the gas column until the level of accumulated liquid below the gas column has been reduced to the desired depth. This causes the gas column to be further compressed without increasing the pressure at the well head. The pressure is then released at the top of the well and expansion of the gas column forces the liquid above the column from the well. This method requires the total volume of the tubing to be filled partly with natural gas and partly with liquid and pressurized to the displacement pressure. The time lag between filling and venting the tubing, and the possibility that the liquid pumped into the tubing may not be recoverable from the tubing by gas expansion makes this method ineffective.

The present invention provides an improved method to remove the accumulated liquid(s) from the tubing of a hydrocarbon producing well by minimizing the volume of pressurized gas required to displace the undesired liquid from the tubing into the casing annulus for disposal into a water bearing formation. This invention also provides a control on the desired frequency to remove liquid(s) from the tubing of a hydrocarbon producing well.

SUMMARY OF THE INVENTION

The primary object of this invention is to provide an improved method and apparatus to periodically remove the accumulated liquid in the tubing of a hydrocarbon producing well to reduce the back pressure which is exerted on the hydrocarbon producing formation due to the weight of the accumulated liquid in the tubing.

Another object of this invention is to provide a surface control system to monitor the back pressure build up which is exerted on the producing formation due to the accumulation of liquids in the well tubing and accordingly perform the operation of the liquid disposal and hydrocarbon production cycles.

Another object is to provide a flow control valve which is closed to temporarily create a liquid accumulation chamber in the tubing. The closed flow control valve seals off a predetermined portion of the well tubing string from upward flow of fluids. The said flow control valve has resilient urging means to yieldably move the valve toward an open position in which the valve may operate in its normal mode. Injection gas delivered by a supply line extending from the well surface to the valve acts to move the flow control valve toward its closed position when the gas pressure in the said supply line exceeds a predetermined value.

Another object of the invention is to provide a flow control valve for connection to the well tubing to control fluid flow therein. The flow control valve is closed when desired to create a liquid accumulation chamber. The closed flow control valve seals off a predetermined portion of the well tubing from upward flow of fluids. The closing and opening of the flow control valve is controlled by two hydraulic control conduits extending between the surface and the flow control valve in the casing annulus. The flow control valve is opened by pressurizing the fluid in the first control conduit and is closed by pressurizing the fluid in the second control conduit.

Another object of the invention is to provide pressure equalizing means to equalize pressure across the closure means of the flow control valve. The pressure equalizing means is opened in response to reducing fluid pressure in the supply line, and is closed by pressurizing the fluid in the supply line.

Another object of this invention is to use the inside volume of a suitable casing string which is cemented and sealed in a second well for storing pressurized gas. The pressurized gas stored in the casing of the second well is used to provide the necessary force to displace the undesired liquid from the tubing to the casing annulus of the hydrocarbon producing well.

Other objects, features and advantages of the invention will be apparent from the drawings, the specification and the claims.

BRIEF DESCRIPTION OF THE DRAWINGS

In the drawings, like numerals indicate like parts and illustrative embodiments of the present invention are shown.

DETAILED DESCRIPTION OF THE PREFERRED EMBODIMENTS

Figure 1:
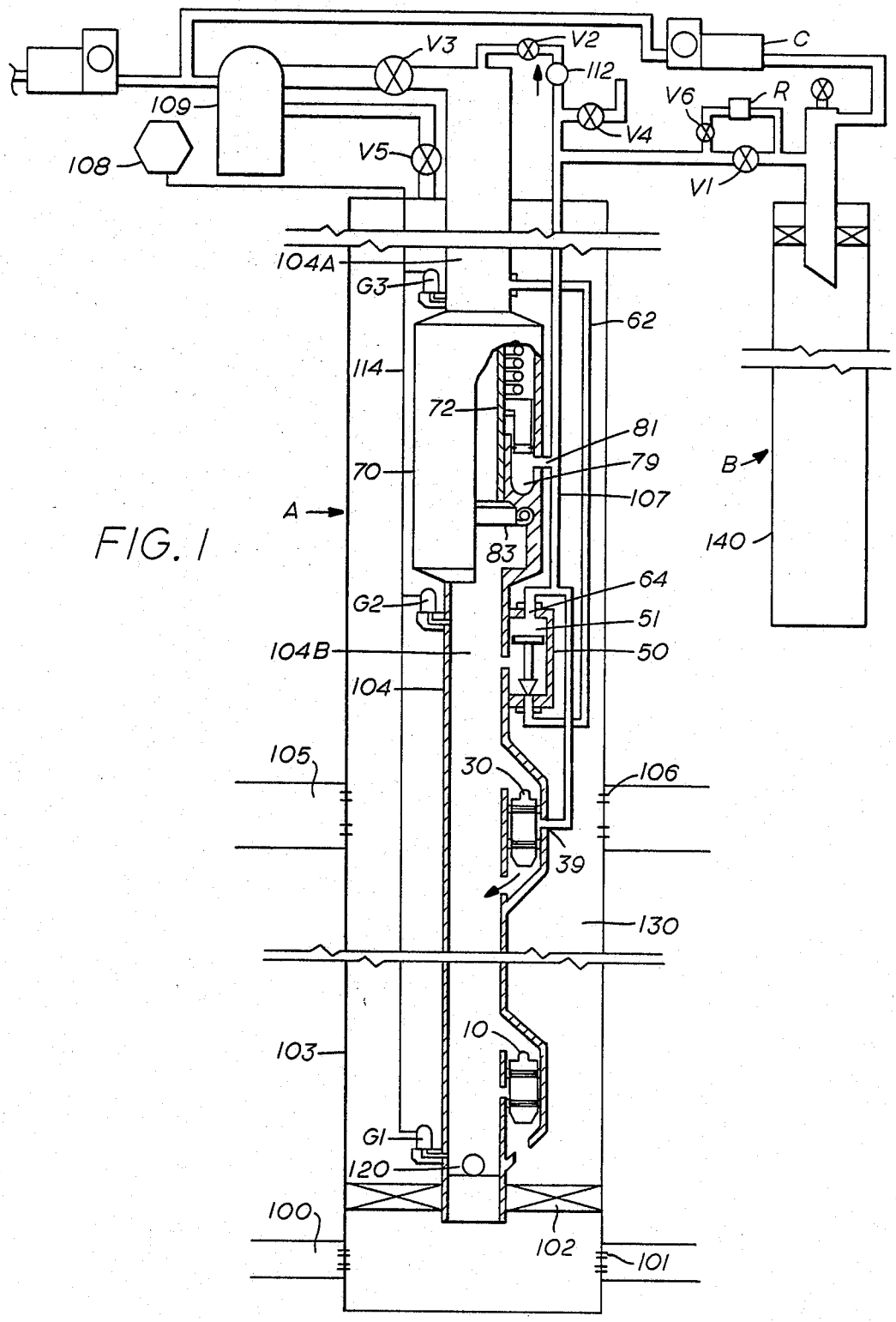
FIG. 1 is an elevational view, partially in section showing the liquid disposal system of the present invention.

In practicing the method of this invention, a hydrocarbon producing well is equipped with casing and tubing and a flow control valve is provided to be connected to the well tubing at a predetermined depth. The flow control valve is normally open allowing fluid production through the tubing, and when closed prevents the upward flow of fluids in the well tubing. A hydrocarbon producing formation, and an upper water bearing formation are both opened to the well bore. A seal means, such as a packer, is placed between the hydrocarbon producing formation and the water bearing formation. A passageway means such as a relief valve is provided to be connected to the well tubing above said packer. A gas supply conduit is provided having a smaller internal diameter than the well tubing and extending in the casing annulus from the surface and connected to the well tubing below the said flow control valve. The gas supply line can be secured to the outside of the well tubing in the casing annulus. High pressure gas is delivered through the gas supply line into the tubing string. The fluids of the hydrocarbon producing formation are produced through the tubing to the surface production facilities. As the fluids are produced in the tubing, part of the produced liquids drop out of the flow and accumulate in the bottom of the tubing. Periodically the well is shut in and the flow control valve is closed. Pressurized gas is then introduced through the supply conduit to pressurize the fluid inside the tubing string below the closed flow control valve. The liquid is then forced out of the tubing through a relief valve. Removal of the undesired liquid from the well may be stopped when desired. For example, when the differential pressure in the tubing string is reduced to the desired level, removal of the undesired liquid is stopped. At this point, gas injection to the supply conduit is stopped. The fluid pressure across the closure means of the flow control valve is reduced and the flow control valve is opened. The producing well is opened to the surface production facilities with reduced back pressure due to the removal of the undesired liquid from the well tubing. In this method, a controller system is provided to control the closing and opening of the surface and subsurface valves used. The controller may operate based on the fluid differential pressure inside the well tubing or the controller may be a timer which controls the sequence of opening and closing of the said valves based on regularly timed cycles.

In another embodiment of the method of this invention, the water bearing formation may be located below the hydrocarbon producing formation. This embodiment is similar to the method described above, except that two packers and a bypass tube are used. The liquid is forced from the tubing into the casing annulus as previously described. When the liquid in the casing annulus rises to a sufficient height to overcome the pressure exerted by the water bearing formation, it is allowed to pass downwardly through the bypass tube to the water bearing formation.

This method allows the volume of pressurized gas required to displace liquids from the tubing into the casing annulus to be minimized. This is due to using a gas supply conduit which has a substantially smaller internal diameter than the well tubing, thus substantially smaller volume must be pressurized to force the liquid from the tubing to the casing annulus. Therefore, gas compression cost and the time lag between filling and venting the tubing are reduced.

FIG. 1 illustrates a hydrocarbon producing well A having a conventional casing 103 with performations 101 providing fluid communication between the producing formation 100 and the interior of the casing 103. A tubing string 104 extends inside the casing 103, and a conventional packer 102 seals the lower part of the casing annulus about the tubing string 102. The hydrocarbon fluids are produced to the surface through tubing 104. Well B has a suitable string of casing 140 which is cemented and sealed to form, in effect, a pressure vessel. Well B is equipped with a proper wellhead and safety means. The casing of well B may be used as a storage tank for high pressure gas supply. The source for high pressure gas can also be a high pressure gas producing well or a gas sales line. Compressor C compresses gas from well A or other gas sources into the casing of well B to maintain the required pressurized gas volume in well B. The flow control valve 70 is provided to be connected to the tubing 104 above packer 102. The flow control valve 70 is closed when desired to block the upward flow of fluids in the tubing 104 at the said valve setting depth. The setting depth of the flow control valve 70 is determined and optimized by the volume of liquids in the tubing 104 which cause the well to approach the "load up conditions". This liquid level limit can be determined by appropriate well tests such as bottom hole flowing pressure tests, and tests to determine the liquid level in the tubing. Several methods can be used to open or close the flow control valve 70. FIG. 1 shows one method in which the opening and the closing of the flow control valve 70 is controlled by the fluid pressure within the gas supply line 107 which extends in the casing annulus 130 from the surface.

A controller 108 is provided to initiate and control the operation of the system of FIG. 1. The controller 108 can be a microprocessor which controls the operation of the system of FIG. 1 based on the downhole fluid pressure differential in the tubing 104, or the controller 108 can be a timer controller which initiates and controls the operation of the system of FIG. 1 based on regularly timed cycles.

The microprocessor controller 108, such as Micromote, manufactured by Systronics, Inc., receives electronic signals (mili amp or mili volt) from suitable pressure transmitters transmitting fluid pressure at different locations inside the tubing 104. In the system of this invention the microprocessor 108, in response to excessive pressure differential inside the tubing 104, initiates the cycle of removing liquid from the tubing 104, and when the undesired liquid is removed from the tubing 104, opens the well A to the producing facilities 109 for production. Any suitable pressure transmitting means can be used to transmit the static or flowing pressures of the fluid inside the tubing 104 to the controller 108. For example, one or more pressure transmitters, such as Gould model 90 DH, manufactured by Gould Inc., can be used. The pressure transmitters may be connected to the well tubing 104 above packer 102 to communicate pressure conditions at different locations inside the tubing 104 to the controller 108. FIG. 1 shows the pressure transmitters G1, G2, and G3 which are in communication with the surface controller 108 via cable 114. Pressure gauge G1 is preferably connected to the tubing close to packer 102 and pressure gauges G2 and G3 are connected to the tubing close to the flow control valve 70. The controller 108 receives electronic signals (mili amp or mili volt) from pressure transmitters G1, G2, and G3. The controller 108 may be programmed to actuate the actuating means of valves V1, V2, V3, V4, V5, and V6 at the surface to their closed or open position when it receives electronic signals equal to the preset value. The literature accompanying this patent application labeled L1 and L2 better describes the operation of the controller 108 and the said pressure transmitters.

The controller 108 detects the load up conditions of well A by determining the difference between the downhole flowing pressures at two or more locations in the tubing 104 such as pressures at transmitters G1 and G2. This pressure difference is indicative of the back pressure exerted on the producing formation due to the weight of liquids inside the tubing 104.

When the back pressure due to the weight of the accumulated liquids in the tubing 104 exceeds a preset amount, the controller starts the liquid disposal process by actuating valves V3 and V6 to their closed positions to shut in well A. Prior to the start of the disposal process valves V1, V2 and V4 are their closed positions. The controller 108 then actuates valve V1 to its open position to allow pressurized gas to flow through the gas supply line 107. The pressurized gas enters the variable capacity pressure chamber 79 of the flow control valve 70 through port means 81 to actuate the flow control valve 70 to its closed position. The supply line 107 is also connected to port 64 through which the fluid pressure in the supply line 107 communicates with the gas pressure dome 51 of the equalizing valve means 50. The gas pressure in the supply line 107 maintains the equalizing valve means 50 in its closed position. Then the injection gas enters into the fluid injection control valve 30 which is a pressure operated valve means through the injection port 39. The injection gas pressure will overcome the closing forces of the fluid injection control valve 30 and actuate it to its open position to permit the injection gas to flow into the lower portion of the tubing string designated as 104B (temporary accumulation chamber) which is sealed off from the upper tubing portion 104A by the closed flapper 83 of the control valve 70. The injection gas pressurizes the fluids inside the tubing portion 104B. The pressurized fluid forces the disposal valve 10, which is connected to the tubing 104 close to packer 102, to its open position. The undesired liquid is displaced through the disposal valve 10 into the casing annulus 130 and disposed of through perforations 106 into the water bearing formation 105. The liquid can also be forced into the casing annulus and the accumulated liquid can be "U" tubed to surface facilities for storage and handling. Check valve 120, which may be of a tubing or wireline retrievable type, is provided to prevent the injection of fluids into the hydrocarbon producing formation 100.

Referring still to FIG. 1, the controller 108 determines the end of the displacement process by monitoring the pressure differential inside the tubing section 104B using pressure signals transmitted by the pressure transmitters G1 and G2. When it is determined that the pressure differential inside the tubing section 104B is reduced to the desired level, gas injection into the supply line 107 is stopped. At this point, the controller 108 closes valve V1 to stop the gas injection and then opens valve V2 to connect the supply line 107 to the tubing 104 to relieve the gas pressure inside the supply line 107 into the upper section of the tubing 104. The pressure inside the supply line 107 can be reduced further to the desired level by venting gas through valve V4. Check valve 112 prevents back flow of gas from the tubing to the atmosphere. When the pressure inside the supply line 107 is reduced, the pressure inside the variable capacity pressure chamber 79 of the flow control valve 70, and the pressure dome 51 of the equalizing valve 50, are also reduced. The reduction of pressure in the dome 51 will cause the equalizing valve 50 to open and permit gas to flow from section 104B through bypass 62, here shown to be a tube, into section 104A of the tubing 104 to reduce fluid pressure across the flapper 83. The pressure equalization process continues until the opening forces acting upon the operator tube 72 of the flow control valve 70 overcome the forces due to a pressure differential that may exist across the flapper 83 and force the flapper 83 to its open position. Controller 108 detects the opening of the flapper 83 from the transmitted pressure differential signals received from the pressure transmitters. For example, if excessive pressure differential is measured by transmitters G2 and G3 across the flapper 83 it indicates to the controller that the flapper 83 is closed. When the pressure differential across the flapper 83 is less than a preset amount indicating the opening of the flapper 83, the controller opens valve V3 to return well A to its producing cycle for production to the sales line. The controller closes valves V2 and V4 and opens valve V6 to allow the pressure regulator R to remain a predetermined amount of pressure in the supply line 107 to keep the equalizing valve 50 in closed position. The compressor C pressurizes the storage well B to the desired pressure for the next disposal cycle. Other methods can be devised to achieve some of the functions of the pressure gauges, G1, G2, G3 without departing from the spirit of the present invention such as a liquid level transmitter to transmit the liquid level in the well tubing 104 or a switch that is mechanically turned on or off by the operator tube to indicate the closure or the opening of the flapper 83. During the disposal cycle, it is possible that gas is forced out along with liquid from the tubing into the casing annulus. It is desirable to periodically vent the casing gas to the production facilities through valve V5 to reduce the casing annulus pressure.

The system of the present invention can utilize another type of flow control valve which is controlled in response to: fluid pressure in a hydraulic control line extending to the well surface; fluid pressure in two hydraulic control lines extending to the well surface; a decrease in tubing pressure; and differential pressure across the valve. The embodiments of the system of the present invention as is described below will show how the system of the present invention can be adapted to use a flow control valve having the above mentioned actuation mechanisms.

Figure 2:
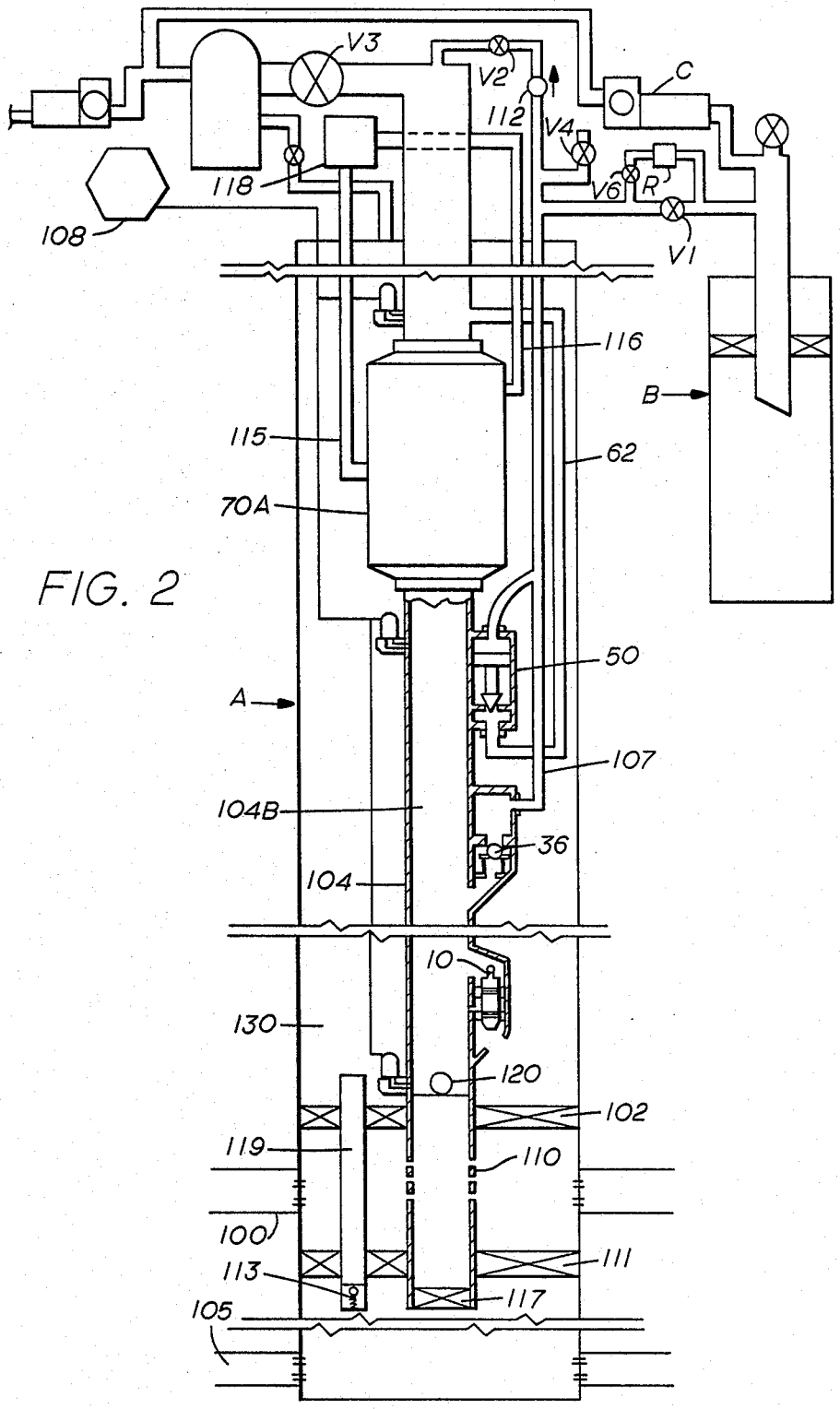
FIG. 2 is an elevational view, partially in section showing another embodiment of the liquid disposal system of the present invention.

Another form of the system of the present invention is shown in FIG. 2. In FIG. 2, the water bearing formation 105 lies below the hydrocarbon producing formation 100. Packers 102 and 111 are set above and below the hydrocarbon producing formation 100. Tubing 104 is sealed off as at 117. The tubing 104 includes a perforated nipple 110 which allows the produced fluids to enter into the tubing 104. Check valve 120 permits upward flow of fluids in the tubing 104 but blocks downward flow of fluids into the hydrocarbon producing formation 100. The closing and opening of the flow control valve 70A is controlled by two hydraulic control lines 115 and 116. The controller 108 initiates the liquid disposal cycle when desired by closing valve V3 to shut in well A. The controller signals pressure manifold 118 to induce pressure to the fluid in the control line 115. The control fluid in turn acts on the operating means of the flow control valve 70A to move the closure means of the flow control valve 70A to its closed position. The controller 108 closes valve V6, then opens valve V1 to allow pressurized gas to flow through the supply line 107. The pressurized gas enters into the tubing portion 104B below the closed flow control valve 70A. The pressurized gas pressurizes the fluids inside the tubing portion 104B and forces the liquid from the tubing into the casing annulus through the disposal valve 10. When the liquid in the casing annulus 130 rises to a sufficient height to overcome the water bearing formation pressure, it flows downwardly through a bypass tube such as 119 into the water bearing formation 105. Check valve 113 prevents upward flow of liquids into the bypass 119. The controller closes the pressurized gas to the supply line when the differential pressure in the tubing is reduced to the desired level. The controller then opens valve V2 to relieve the pressure in the supply line 107 into the top of the tubing 104. In the system depicted in FIG. 2, the pressure inside the supply line 107 is reduced to open the equalizing valve means 50 to reduce the pressure differential across the closure means of the flow control valve 70A. Then the controller signals the pressure manifold 118 to relieve the induced pressure from the control line 115 and apply a predetermined amount of pressure to the fluid in the control line 116. The fluid pressure in the control line 116 in turn acts on the operating means of the flow control valve 70A to move the closure means of the flow control valve 70A to open position. The operating means of a flow control valve operated by two hydraulic lines has been described. The controller then opens valve V3 to allow the fluid flowing up the well to flow into the sales line. The use of a gas injection control valve 30, as shown in FIG. 1, is optional in this system since the operation of the flow control valve is independent of the pressure in the supply line 107. Check valve 36 is provided to prevent back flow of fluid from the tubing into the supply line 107. The use of a flow control valve which is controlled by hydraulic control lines provide a better control in opening the flow control valve because greater opening force can be provided to open the flow control valve 70A. The disadvantage is that there is additional expense in providing control lines and means to pressurize the fluid in the control lines.

Another form of the liquid removal system of this invention can employ a subsurface actuated flow control valve such as a flow control valve described in U.S. Pat. No. 3,980,135 in place of a surface controlled flow control valve. A subsurface controlled flow control valve is held open by the normal downhole pressure at the valve. It automatically closes when the downhole pressure drops below a predetermined level. After closure, applied tubing pressure in excess of the downhole pressure below the valve returns the valve to the open position. When a subsurface actuated flow control valve is used for this invention, the disposal cycle and the pressure equalization cycle procedures are the same as previously described in the system of FIG. 1, except the subsurface actuated flow control valve is closed automatically when the downhole pressure at the valve depth drops below a predetermined amount. The controller detects the closure of the subsurface actuated flow control valve. One way the controller may detect the closure of the subsurface actuated flow control valve is from a decrease in the flowing tubing pressure at the surface. The controller closes the tubing to the production facilities and starts the liquid disposal procedure as described in the system of FIG. 1. To open the subsurface actuated flow control valve the pressure across the closure means of the subsurface actuated flow control valve is equalized as described in the system of FIG. 1. Then pressurized gas is introduced to the top of the tubing from the pressurized gas source to exceed the fluid pressure below the closed valve and force the subsurface actuated flow control valve to its open position. This system has the advantage of using a less expensive flow control valve than the systems of FIG. 1 and FIG. 2. However, to open the flow control valve additional pressure must be supplied to the tubing which results in a less efficient system.

The system of this invention can also employ a conventional safety valve which is controlled by a single hydraulic control line, such as the safety valves described in U.S. Pat. Nos. 4,376,464 and 4,161,219, to substitute the flow control valve of the system of FIG. 2. Generally, these types of valves are biased to the closed position and are opened in response to fluid pressure applied from the surface through a control line. These types of safety valves are limited in their depth of operation because resilient urging means biasing the safety valve to a closed position must overcome the hydrostatic head pressure in the hydraulic control line. These types of flow control valves can be used in a liquid removal system for a shallow well.

As stated, the present invention utilizes a flow control valve to create a temporary liquid accumulation chamber in the tubing of a hydrocarbon producing well. Examples of fluid operated flow control valves, better known as safety valves, may be found in U.S. Pat. Nos. 4,252,197; 4,161,219; and 4,452,310. The present invention includes a method to modify these types of safety valves to better serve the objectives of the present invention. For the purpose of illustration, the modification will be shown as incorporated in a flapper type safety valve, such as a piston actuated well safety valve described by Pringle in U.S. Pat. No. 4,252,197. It will be understood that the present invention may utilize other modified flow control valves, such as tubing retrievable, or wire line retrievable control valves. Flow control valves having various other types of valve closing elements such as ball or poppet elements may be used. Similarly, other fluid operated valves with a closing and opening mechanism actuated by fluid flow or fluid pressure may be used.

Figure 3A:
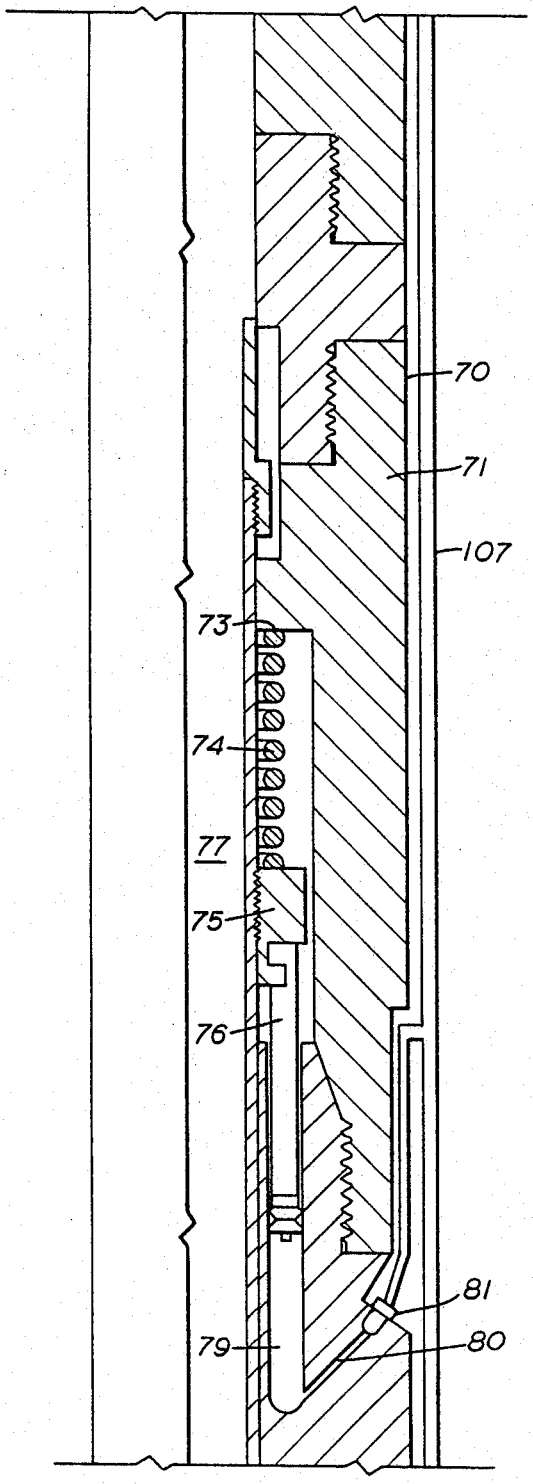
FIGS. 3A and 3B are continuations of each other of a fragmentary elevational view, partly in cross section, of a flow control valve to control fluid in the well tubing and is shown in open position.
Figure 3B:
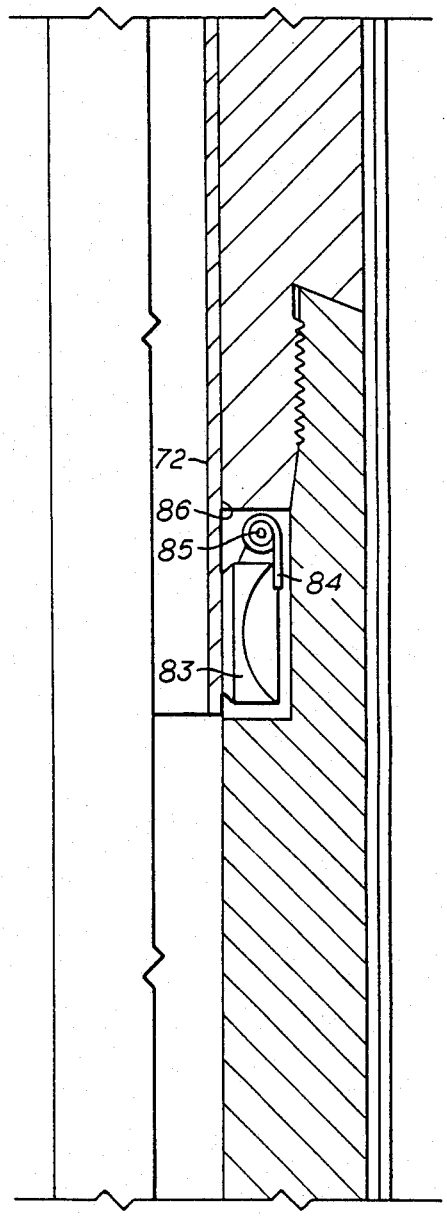

Referring to FIG. 3A and FIG. 3B, the flow control valve 70 of the present invention is shown as being of a tubing retrievable type. The flow control valve 70 generally includes a valve housing 71 that permits fluid to flow through bore 77. The flow control valve 70 includes a valve closure member such as a flapper 83 which is carried about a pivot pin 85. The flapper 83 may include a spring 84 for yieldably urging the flapper 83 about the pivot pin 85 and onto an annular valve seat 86 which is positioned about the bore 77 for closing valve 70 to block fluid flow from the lower portion of the tubing 104, indicated by reference 104B, to the upper portion of the tubing 104, designated as 104A.

An operator tube 72 is telescopically moveable in the housing 71 and through the valve seat 86. When the operator tube 72 is moved downward, the operator tube 72 pushes the flapper 83 away from the valve seat 86. Thus the flow control valve 70 is held in the open position. When the operator tube 72 is moved upward, the flapper 83 is allowed to move upward onto the seat 86 by the action of the spring 84. Several methods can be used to control the closing or opening of the flow control valve 70. One method is to control the closing and the opening of the flow control valve 70 by the application or removal of pressurized gas through the gas supply line 107 which is connected to the valve housing 71 at port means 81. In operation, when gas is injected into the supply line 107 from the surface, the gas pressure is applied to suitable hydraulic fluid in the pressurizing chamber 79 through passageway means 80 and the hydraulic fluid in turn applies pressure to the lower end of one or more pistons 76 which in turn engage the operator tube 72 such as by a tongue and groove connection 75 to move the operator tube 72 upward causing the flapper 83 to move to its seated position. When it is desired to open the flow control valve 70, the fluid pressure in the supply line 107 is reduced. Any suitable biasing means can be used such as a spring 74 or a pressurized gas chamber (now shown), which may act between a shoulder 73 on the valve housing 71 and against the upper end of the pistons 76 for yieldably urging the operator tube 72 in a downward direction to force the flapper 83 to its open position for opening the flow control valve 70. The upper end of the pistons 76 are exposed to the tubing pressure. Thus the tubing pressure acts on the upper end of the pistons 76 and provides additional force to move the operator tube 72 downward.

Figure 4:
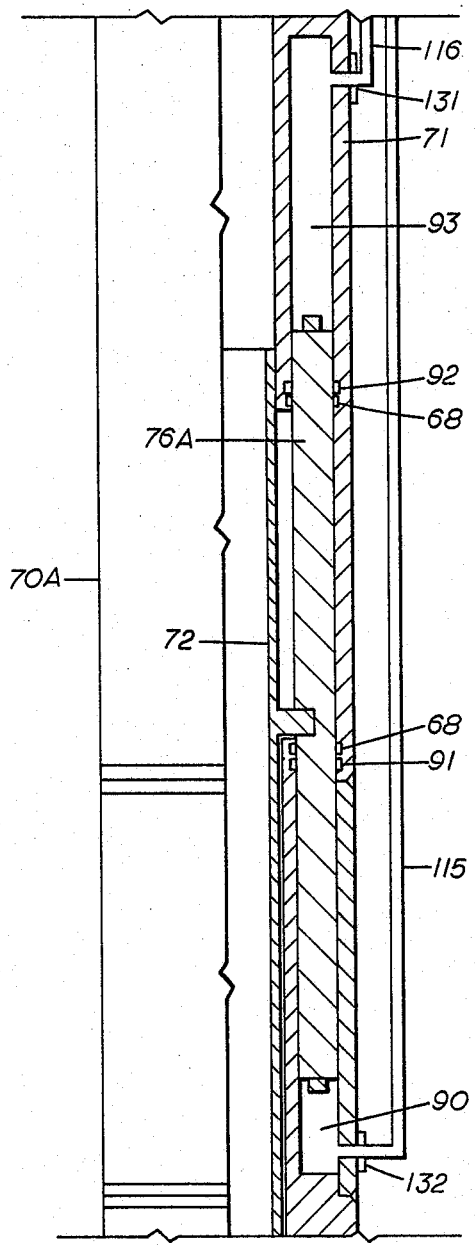
FIG. 4 is a fragmentary elevational view partly in cross section, of another form of actuating piston means for the flow control valve of this invention.

Referring now to FIG. 4, a further embodiment of the means for moving the tubular member 72 to upward and downward positions is shown. In this embodiment, hydraulic control line 116 is connected to the valve housing 71 at port means 131. The fluid pressure within the control line 116 communicates with the pressurizing chamber 93 through port 131. One or more pistons 76A which are telescopically moveable in the housing 71 are provided. The hydraulic control line 115 is connected to the housing 71 at port means 132. The fluid pressure within the hydraulic line 115 communicates with the pressuring chamber 90 through port 132. The pistons 76A move in the pressurizing chamber 93 and are sealed therein by means of suitable seals 92. The pistons 76A can also move in the pressurizing chamber 90 and are sealed therein by means of suitable seals 91. Wiper means 68 are provided to prevent the engagement of solid matter with the pistons 76A. The piston assembly shown in FIG. 4 can be used to provide means to open and to close the closure means of the flow control valve of this invention in response to fluid pressure transmitted to the piston assembly through control lines 116 and 115. In operation when control fluid within control line 116 is pressurized and the pressure in the control line 115 is reduced the pistons 76A move the operator tube 72 downwardly and the flow control valve 70A is opened. When control fluid within control line 115 is pressurized and the pressure in the control line 116 is reduced the pistons 76A move the operator tube 72 upwardly and the flow control valve 70A closes. Hydraulically controlled actuation means of the flow control valve 70A provide a better surface control for closing or opening of the flow control valve 70A than the actuation means of the flow control valve 70 which is controlled by the supply line pressure. The disadvantage of the flow control valve 70A is additional expenses for control lines and means for pressurizing the hydraulic fluid. Prior art flow control valves which are controlled by two hydraulic control lines such as the safety valve described in U.S. Pat. No. 4,201,363, utilizes resilient urging means to close the safety valve in order to accomplish the objectives of a safety valve. The hydraulically controlled form of the flow control valve of this invention differs from the prior art in that it does not utilize resilient urging means to close the flow control valve.

U.S. Pat. No. 4,376,464 describes a safety valve in which the pistons moving the operator tube annularly surround the operator tube of the safety valve. This type of piston assembly can be modified for use in the flow control valve of the present invention to provide means to move the operator tube upwardly upon application of fluid pressure through the supply line 107 to the piston assembly.

Figure 5:
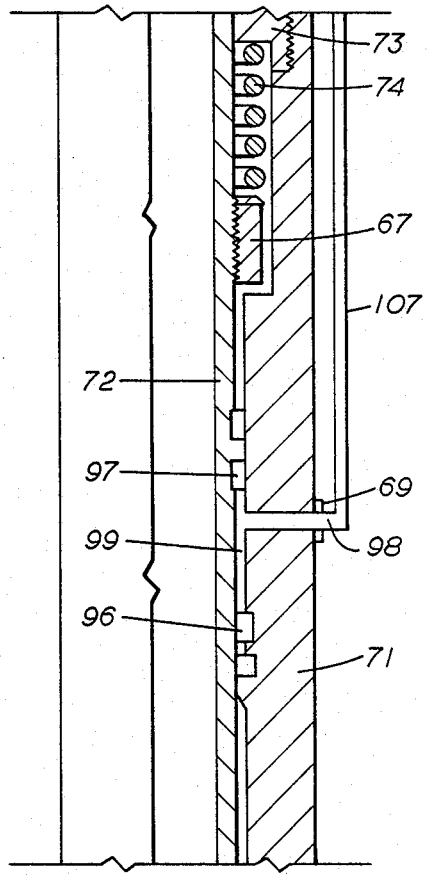
FIG. 5 is a fragmentary elevational view partly in cross section of another form of actuating piston means for the flow control valve of this invention.

FIG. 5 shows a piston assembly to control the movement of the operator tube 72. In this embodiment, suitable seals 96 and 97 provide a variable capacity pressure chamber for receiving fluid pressure from the supply line 107. The supply line 107 is connected at port 69 to the valve housing 71. There is a fluid passageway 98 leading from port 69 to a variable capacity chamber 99. The fluid under pressure enters the variable capacity chamber through passageway 98 and is confined between seals 96 and 97, but with seal 97 carried about the circumference of the operator tube 72 the fluid pressure causes the operator tube 72 to be moved upwardly. Any suitable resilient urging means 74 (here shown to be spring) may be positioned between a shoulder 73 on the valve housing 71 and against the shoulder 67 on the tubular member 72 for yieldably urging the operator tube 72 in a downward direction to force the flapper 83 to its open position. The tubing pressure also acts on the upper end of the seal 97 and provides additional force to move the operator tube 72 downwardly. The piston assemblies moving the operator tube as shown in FIGS. 3A and 4 are preferred because the flow control valve's pressurizing chamber is out of communication with the operator tube 72, thereby eliminating the large seals about the operator tube 72.

Figure 6:
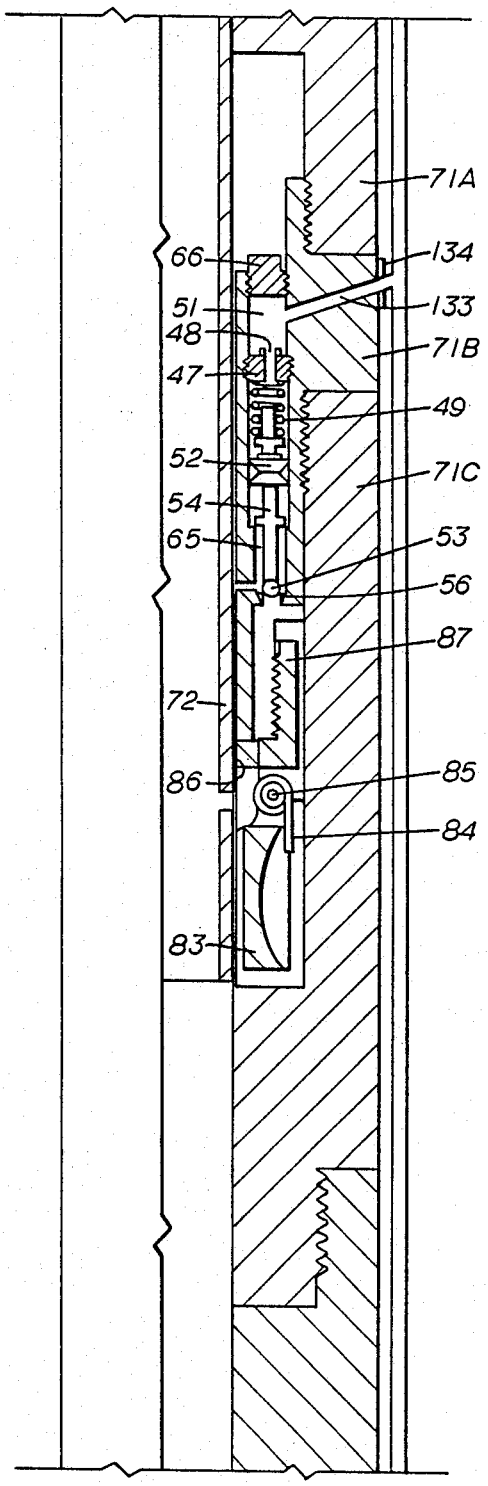
FIG. 6 is a fragmentary elevational view partly in cross section of an equalizing subassembly to equalize pressure across the closure mean of the flow control valve of this invention.
Figure 8:
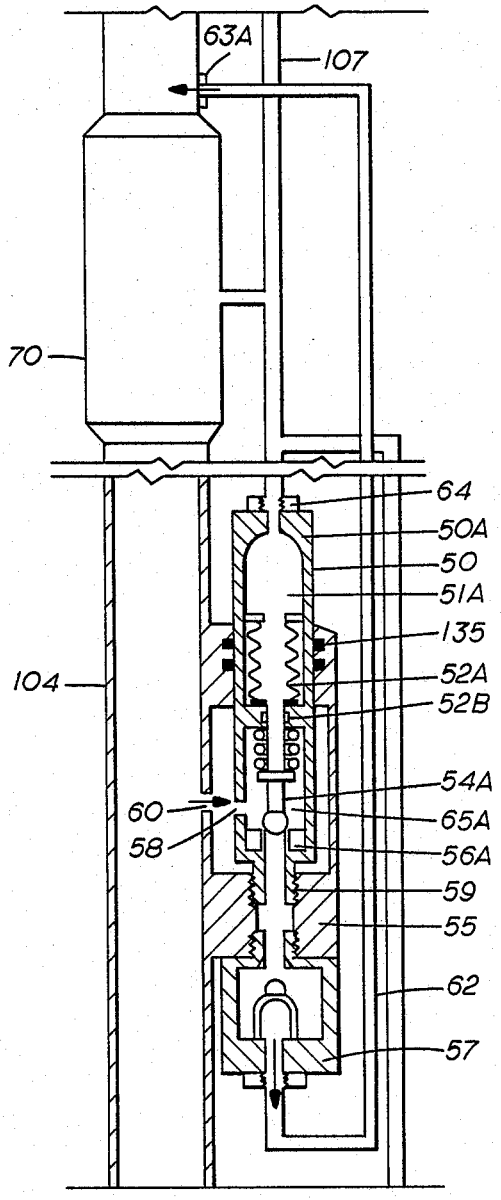
FIG. 8 is a vertical, partly sectional view of an equalizing valve positioned in a mandrel connected in the well tubing.

The present invention contemplates providing pressure equalizing means to reduce pressure across flapper 83 before opening the flow control valve 70. The flow control valve 70 may include an equalizing subassembly, as shown in FIG. 6, which is opened to equalize pressure across flapper 83. Another form of the equalizing means as shown in FIG. 8 can be connected to the well tubing to control bypassing of fluid pressure across flapper 83 through a bypass means.

Referring to FIG. 6, in this embodiment the flow control valve 70 includes the equalizing subassembly 71B. The equalizing subassembly 71B is connectable in the flow control valve 70 between valve housing member 71A and 71C with the equalizing subassembly 71B extending axially between the operator tube 72 and the valve housing 71. As in U.S. Pat. No. 4,376,464, the threaded flapper subassembly 87 to which is attached the flapper valve 83 is secured to the equalizing subassembly 71B, by providing locking means such as plurality of set screws (not shown). In the housing of the equalizing subassembly 71B there is a longitudinal flowway 65 in which is housed a suitable pressure responsive means such as a piston rod 54 with piston seals 52 which are reciprocally moveable therein. The valve member 54 cooperates with seat 56 to control fluid flow through the flowway 65. The upper end of the flowway 65 is sealed by a suitable seal means such as a threaded bolt 66. Thus, a pressurizing chamber 51 is defined between the upper end of the piston seals 52 and the closed upper end of the flowway 65. The supply line 107 is connected to the equalizing subassembly 71B at port means 134. The pressurizing chamber 51 is in communication with the supply line 107 through passageway 133. A suitable choke means, such as threaded choke means 47 with passageway 48, is provided in the pressurizing chamber 51. The choke 47 provides a restriction to the flow of fluids in the pressurizing chamber 51. Viscous silicon fluid may be injected into the pressurizing chamber 51 during valve assembly to act as a damper during valve opening. Any suitable resilient urging means, such as a spring 49, may be provided to act between the lower end of the choke 47 and upper end of valve member 54 to assist in maintaining the valve member 54 in a closed position.

In operation, the pressure in the supply line 107 acts on the upper end of piston seals 52 and, assisted by the force of spring 49, urges valve member 54 to its seated position. During the disposal cycle, valve member 54 remains in a closed position because the closing forces that are acting on the valve member 54 are greater than the opening forces. The following demonstrates the relationships between opening and closing forces acting on the valve member 54 during the disposal cycle:

Ap=The area of the piston 52
Av=The area of the seat 56
Pd=The pressure inside dome 51
Pb=The pressure below seat 56
Pd=Pb
Pa=The pressure above flapper 83
Fs=The closing force of spring 49
$Ap > Av$
$Pb > Pa$
$Pd \times Ap > Pb \times Av + Pa \times (Ap - Av)$
$Pd \times Ap + Fs > Pb \times Av + Pa \times (Ap - Av)$ This shows that during the disposal cycle the closing forces acting on the equalizing valve are greater than the opening forces, thus the equalizing valve means remain in closed position.

Figure 7A:
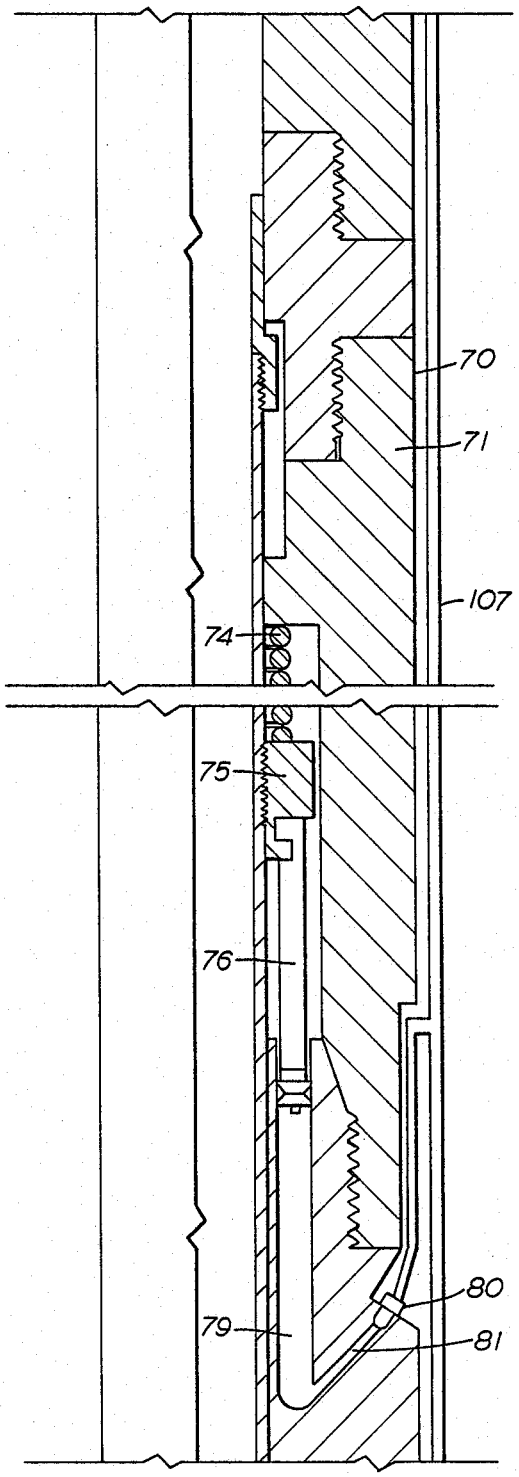
FIGS. 7A and 7B are continuations of each other of a fragmentary elevational view, partly in cross section, of a flow control valve in closed position and its equalizing subassembly in open position.
Figure 7B:
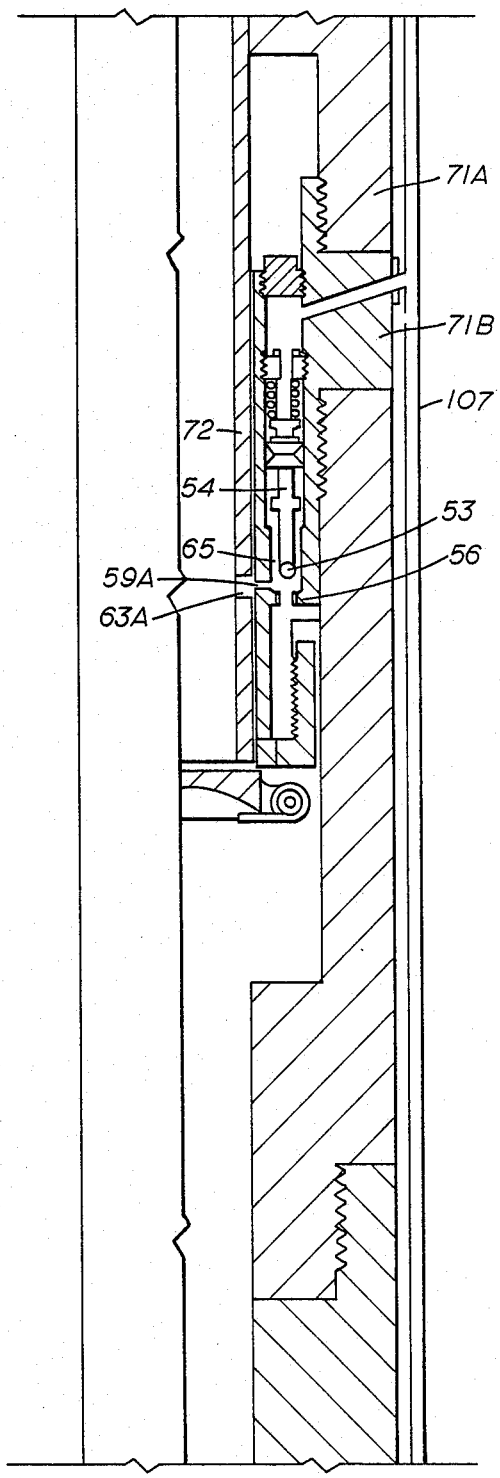

During the equalization process, the pressure inside the supply line 107 is reduced to open the equalizing valve means. The tubing pressure below the flapper 83 acts on the valve member tip 53 and the tubing pressure above flapper 83 acts on the lower end of piston 52 to move valve member 54 upward to its open position. FIG. 7A and FIG. 7B show the flow control valve 70 in its closed position, and the equalizing subassembly 71B in open position. When the equalizing valve is opened, gas flows from below the flapper 83 to the area above the flapper through passageway 65 and through one or more equalizing ports such as 59A and 63A which are provided in the equalizing subassembly 71B and the operator tube 72. FIG. 7B shows that the equalizing ports 63A and 59A are aligned when the flow control valve 70 is closed and the operator tube is in upward position. Thus when the equalizing valve means opens, gas will flow through the equalizing ports 59A and 63A into the tubing.

Flapper 83 will remain in a closed position until the differential pressure across the flapper 83 is reduced to a point that the opening forces acting on the operator tube 72 move the operator tube 72 downward and move the flapper 83 to its open position. Additional pressure can be supplied to the dome 51 through the supply line 107 to assist spring 49 to move valve member 54 to its closed position. The pressure supplied to the dome 51 to close the equalizing valve means is less than the pressure required to overcome the opening forces of the flow control valve 70.

FIG. 8 shows another form of an equalizing means for connection to the tubing 104. The equalizing valve 50 is a dome pressure operated valve and has a housing 50A with a flowway 65A therein. The equalizing valve 50 has a threaded outlet 59 attached to the mandrel lug 55. The equalizing valve 50 is sealed against the internal wall of the mandrel lug 55 using suitable seals 135. The outlet 59 communicates with the bypass tube 62 through a check valve 57. Check valve 57 allows flow of fluid from the outlet of the equalizing valve 50 to the bypass tube 62 but prevents flow from the bypass tube 62 into the well tubing. The upper end of the bypass tube 62 is connected to the tubing 104 at port 63A. The equalizing valve 50 has an inlet 58 communicating with the fluid pressure inside the tubing portion 104B through inlet 60 of the mandrel 55. The equalizing valve 50 has a valve member 54A therein which cooperates with a seat 56A in the flowway 65A to control flow through the equalizing valve 50. The equalizing valve 50 has a pressure dome 51A which is in fluid communication with the supply line 107 through port 64. Thus, the pressure in the pressure dome 51A may be varied by changing the pressure inside the supply line 107. The pressure dome 51A is closed by a suitable pressure responsive means such as bellows 52A which is connected to the valve member 54A. The valve member 54A is moved downward to its seated position by dome gas pressure admitted through port 64 from the gas supply line 107 and is moved upwardly to open valve 50 by the pressure of fluids in the tubing 104. During the production cycle of the hydrocarbon producing well, it is desirable to keep the equalizing valve 50 in a closed position. This can be accomplished by maintaining fluid pressure to dome 51A through supply line 107. It is desirable to minimize the pressure in the supply line 107 during the production cycle of the hydrocarbon producing well to maintain valve 50 in the closed position. This is important when this type of equalizing means is used in a system where the flow control valve 70 is also controlled by the pressure in the supply line 107. The pressure in the supply line 107 during the production cycle should be less than the pressure that will close the flow control valve 70. The pressure required to maintain the equalizing valve 50 during the production cycle can be minimized by reducing the effective area where the tubing pressure is acting to open the valve 50. Suitable seals 52B are provided to seal off the bellows 52A from the effect of tubing pressure. Seals 52B may have a smaller area than the effective area of the bellows 52A. This will reduce the opening forces acting on the valve 50 due to the tubing pressure.

The novelty of the flow control valve 70 of this invention is (1) its purpose, to temporarily seal off a portion of the tubing below the flow control valve from the portion of the tubing string above the flow control valve; (2) the flow control valve of this invention is biased to the open position; (3) the operation of its equalizing subassembly is novel; and (4) the method of operation of the flow control valve is novel. Two methods of operation have been discussed. One method of operation is that the flow control valve of this invention is closed by pressurizing the gas supply line. The flow control valve is opened by the force of the resilient urging means provided in the flow control valve, and opening forces due to tubing pressure when the pressure in the supply line is relieved. Another method of operation uses two hydraulic control lines to control the closing and opening of the flow control valve of this invention. It differs from known hydraulically controlled valves because resilient urging means are not used to close the flow control valve.

Figure 9:
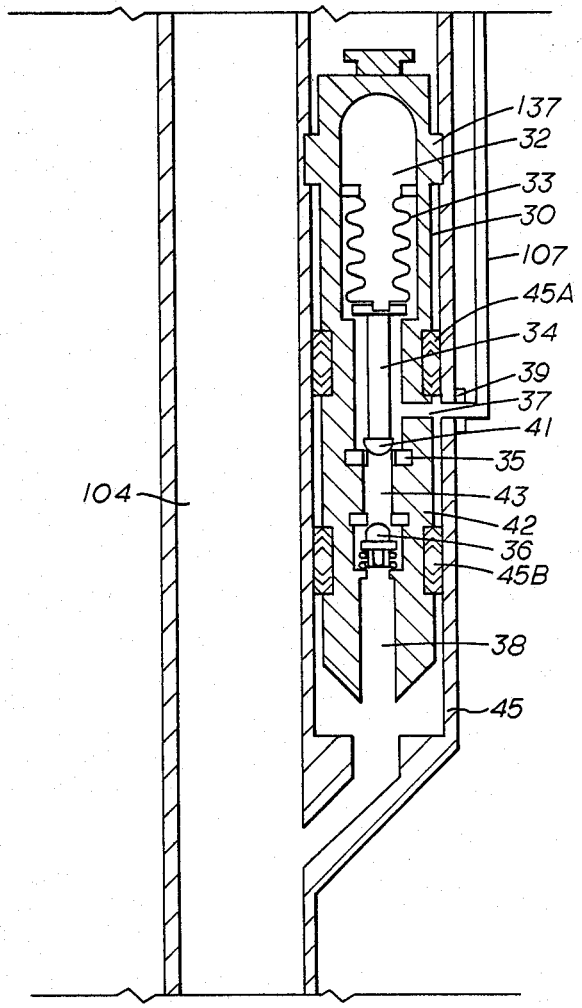
FIG. 9 is a cross sectional fragmentary view of an injection control valve positioned in a mandrel connected in the well tubing to control injection of pressurized gas into the well tubing.

FIG. 9 shows a wireline retrievable fluid injection control valve 30 which is similar to a dome pressure charged gas lift valve. One or more injection control valves are used to control the sequence of the closure of the equalizing valve 50, closure of the flapper valve 83, and the start of the disposal process respectively. The injection control valve 30 may be a part of the flow control valve 70 as shown in FIG. 11 or can be a separate tubing retrievable or wireline retrievable valve for connection below the flow control valve 70 in the tubing 104 as shown in FIG. 9.

FIG. 9 shows a wireline retrievable fluid injection control valve 30 secured in the mandrel 45 using suitable lock means 137 and suitable seal means 45A and 45B. The supply line 107 is connected to the mandrel 45 at port 39. The valve 30 has a housing 42 with a flowway 43. The flowway 43 has an inlet 37 communicating with the supply line 107 through port 39. The valve 30 has a valve member 34 therein which cooperates with a seat 35 in the flowway 43 to control flow through the injection valve 30. The valve member 34 is urged toward a seated position by a charge of fluid under pressure in the dome 32 of the injection control valve 30. The dome is closed by suitable pressure responsive means such as bellows 33. In operation, the opening forces due to gas pressure provided by the supply line 107 acting upon bellows 33 and assisted by tubing pressure acting upon the valve member stem tip 41, overcome the closing forces due to the fluid pressure in the dome 32. This causes the bellows 33 to move upward and lift the valve stem tip 41 off the valve seat 35. The injection gas is then able to flow through the valve 30 and through outlet 38 into the lower section of the tubing 104 below the closed flapper 83.

The pressure in the dome 32 is set to ensure that the injection control valve will not open until the gas pressure from the supply line 107 has actuated the flow control valve 70 and the equalizing valve 50 to their closed positions. Viscous silicon fluid is injected into the bellows 33 during valve assembly to act as a damper during valve opening. Reverse flow through valve 30 from the tubing 104 to the supply line 107 is prevented by a spring loaded check valve 36.

Figure 10:
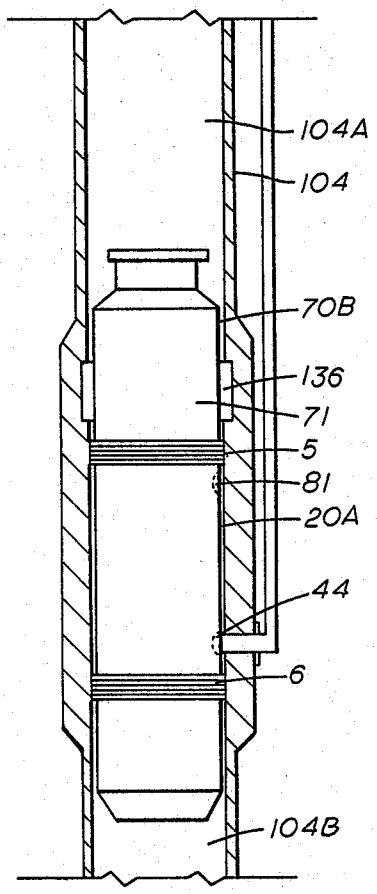
FIG. 10 is a fragmentary elevational view of a wireline retrievable flow control valve installed in a well tubing.
Figure 11:
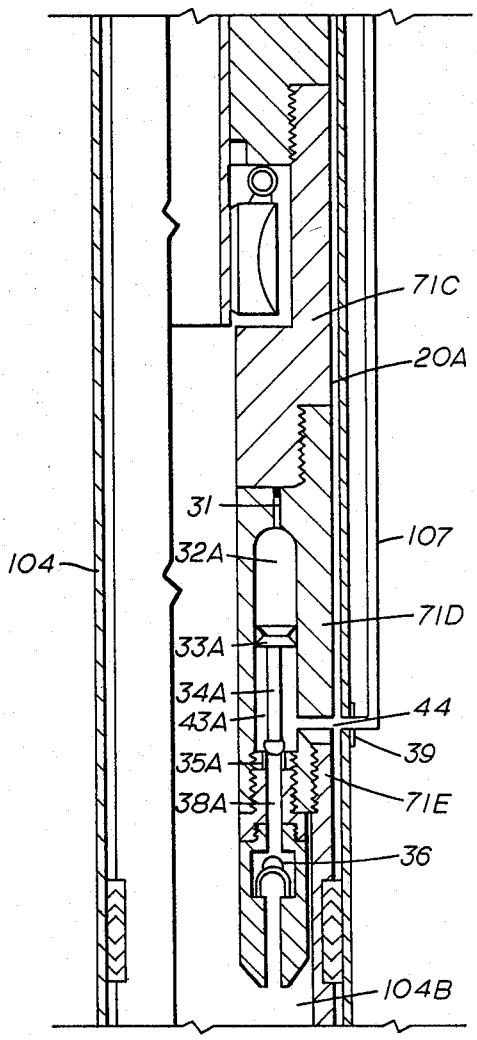
FIG. 11 is an elevational view, partially in section showing an injection control subassembly.

Another embodiment of the fluid injection control assembly is shown in FIG. 10 and FIG. 11 in which the flow control valve 70B includes a fluid injection control subassembly. FIG. 10 shows a flow control valve 70B, of a wireline retrievable type, for connection in a well tubing by a conventional lock 136. The flow control valve 70B has a housing 71 adapted to be positioned in the tubing 104 and sealed against the tubing 104 using suitable seals 5 and 6. The flow control valve 70B in addition to all the features of the tubing retrievable flow control valve 70 as previously described, may also include one or more fluid injection control subassemblies. FIG. 11 shows the injection control subassembly 71D for connection to the flow control valve 70B. The injection control subassembly 71D is connectable in the flow control valve 70B between valve housing members 71C and 71E. There is preferably disposed within said injection control subassembly 71D, a flowway 43A. Within flowway 43A is housed a valve member 34A cooperating with seat 35A in the flowway 43A to control flow of fluid in the flowway 43A. The supply line 107 is connected to the injection port 39 which is provided in the tubing 104. The flowway 43A has an inlet 44 which is exposed to the pressure in the supply line 107. The flowway 43A has an outlet 38A leading into the tubing 104. Valve member 34A includes pressure responsive means, such as piston 33A, capable of longitudinal sliding movement within the dome gas chamber 32A. The dome 32A is pressurized to a desired pressure through passageway 31 during valve assembly. The valve member 34A is urged to a downward and seated position by the pressure in the dome gas chamber 32A. In operation, the injection gas from the supply line 107 enters into the annulus 20A and through port 81 (shown in FIG. 10) into the pressure chamber 79 of the flow control valve 70B to close the valve 70B. When the opening forces acting on the piston 33A due to the gas pressure in the supply line 107 exceed the closing forces acting on the valve member 34A, valve member 34A moves upward and permits gas to flow from inlet 44 through outlet 38A into tubing section 104B to pressurize the fluid in the tubing section 104B and force the liquids from the tubing section 104B through a disposal valve to the casing annulus. Reverse flow through the injection valve subassembly 71D is prevented by a check valve 36.

Figure 12:
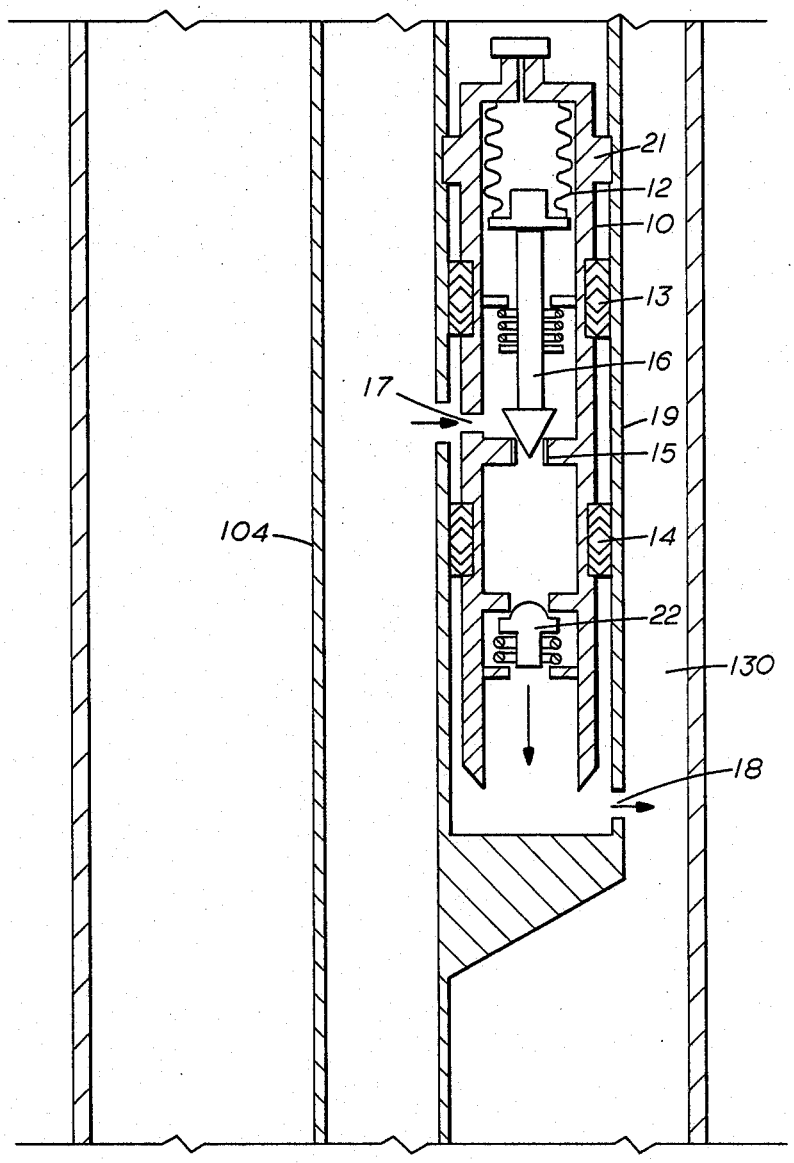
FIG. 12 is a cross sectional view of a disposal valve positioned in a mandrel connected in the well tubing.

FIG. 12 illustrates a wireline retrievable disposal valve 10 secured in the mandrel 19 using suitable lock means 21 and suitable seals 13 and 14. Valve 10 is a relief valve, which can be of a tubing retrievable or wireline retrievable type. The disposal valve 10 controls flow of fluid from the tubing into the casing annulus. The disposal valve 10 is a dome pressure charged and/or spring loaded relief valve which is subject on one side to the fluid pressure in the interior of the tubing 104 and on the other side to the fluid pressure in the annulus 130. Valve 10 is preset to a desired opening pressure and will open to allow fluid to pass from the interior of the tubing 104 to the annulus 130 when the pressure inside the tubing 104 exceeds the pressure in the annulus by the preset amount. One or more disposal valves can be used to achieve the above objectives.

Referring to FIGS. 1 and 12, in operation, injection gas enters into the lower section of the tubing 104, designated as 104B, which is sealed off from the upper section 104A by the closed flapper 83. The injection gas pressure and the hydrostatic pressure of the liquids in the tubing section 104B force the bellows 12 and the valve member 16 to move upwardly to let fluid from port 17 pass through seat 15 and through disposal port 18 to the annulus 130 for disposal. Check valve 22 is provided to prevent back flow of fluid from annulus 130 into the tubing 104.

Thus, it has been demonstrated that the method of present invention provides an advantage over the prior art in that the pressurized gas volume required to dispose of the undesired liquid from the well tubing is minimized and a better surface control is provided to control the frequency of the dewatering cycle of the hydrocarbon producing well.

What is claimed is:

1. A system for controlling the operation of a liquid disposal cycle and the operation of a production cycle of a hydrocarbon producing well, comprising:

a pressurized gas source to provide the necessary pressure to force an accumulated liquid from a well tubing disposed within a well into a casing of a hydrocarbon producing well for disposal;

a supply line connected to said pressurized gas source and extending in a well annulus from the surface of said well, and connected to said well tubing below the surface of the earth;

a controller which initiates the steps of production and disposal cycles of said hydrocarbon producing well in response to a pressure differential between predetermined locations within said well tubing, said controller having valve actuating means to actuate a series of valve means to closed or open positions;

a first valve means controlling the flow of pressurized gas from the pressurized gas source into said supply line, said first valve means being actuated to its open or closed positions by said controller;

a second valve means, controlling the flow of said pressurized gas from said supply line to the top of said well tubing, said second valve means being actuated to its open or closed positions by said controller;

check valve means to prevent back flow of gas from said well tubing to said supply line;

a third valve means controlling the flow of vent gas from said supply line to the atmosphere, said third valve means also being actuated to its open or closed position by said controller;

a fourth valve means controlling the flow of produced fluids through said well tubing of said hydrocarbon producing well at the surface;

pressure transmitting means transmitting pressure data within the well tubing to said controller;

data processing means which processes the said transmitted pressure data to determine the frequency and duration of said liquid disposal and production cycles of the hydrocarbon producing well, and accordingly operate said valve actuating means of said controller to start or stop said cycles;

a flow control valve connected to the well tubing below the surface of said well, said flow control valve being biased to an open position to allow well fluid production therethrough, and being moved to a closed position, when fluid pressure in said supply line exceeds a predetermined pressure, said control valve thereby blocking the upward flow of well fluids in the well tubing;

an equalizing means connected to said well tubing to equalize fluid pressure on both sides of said flow control valve before opening said flow control valve, said equalizing means further comprising:

a housing having a flowway therethrough with an inlet communicating with the well tubing below said flow control valve and an outlet communicating with a bypass conduit leading to the well tubing above a closure means of said flow control valve;

a cooperable valve member and valve seat, to control the flow of fluid through said flowway;

a dome gas chamber connected to said supply line, the pressure in said supply line being in equilibrium with the pressure in said dome gas chamber;

pressure responsive means connected to said cooperable valve member, and exposed on one side to the tubing pressure and on the other side to the dome gas pressure, so that when the pressure inside said supply line is reduced, said equalizing means opens to permit passage of well fluid to said bypass conduit to equalize fluid pressure on both sides of said closure means of said flow control valve;

choke means in said dome gas chamber to provide a dampening effect during valve opening by restricting the flow of fluids from said dome gas chamber;

an injection control valve means to control the order of succession of the closing of said flow control valve and gas injection into the lower portion of the well tubing below said flow control valve;

check valve means connecting to an outlet of said injection control valve means to prevent back flow of fluid from well tubing into said supply line;

a passageway in the well tubing through which fluid may be forced from the well tubing into a casing annulus when the well tubing pressure exceeds a predetermined amount;

check valve means connected to an outlet of said passageway to prevent back flow of fluid from casing annulus into the well tubing; and pressure regulating means to regulate pressure in said supply line to maintain said equalizing means in closed position during the production cycle of said hydrocarbon producing well.

2. The system according to claim 1, wherein the pressurized gas used to displace liquid from the well tubing of the hydrocarbon producing well is stored inside a casing of a second well.

3. The system of claim 1 wherein the said controller is a timer which initiates the steps of the disposal and production cycles of the hydrocarbon producing well in response to preset time cycles.

4. The system according to claim 1, wherein the operation of said flow control valve is controlled by the fluid pressure in two separate control conduits, when the pressure in the first control conduit exceeds the pressure in the second control conduit, said flow control valve opens, when the pressure in the second control conduit exceeds the pressure in the first control conduit, said flow control valve closes.

5. The system of claim 1 wherein the said flow control valve is a subsurface actuated flow control valve which closes when the pressure in the said well tubing drops below a predetermined amount and opens when the tubing pressure above the said subsurface actuated valve exceeds the pressure below the said valve.

6. The system according to claim 1 wherein said flow control valve is a surface actuated flow control valve which is biased to an open position and is closed by application of hydraulic fluid pressure through a single control conduit.

7. A method of removing accumulated liquids from a hydrocarbon producing well having a casing with perforations at a producing formation and perforations at a water bearing formation, said casing further having a string of well tubing disposed within it, the method of liquid removal comprising:

(a) sealing off a portion of said casing between a lower hydrocarbon producing formation and an upper water bearing formation, (b) producing well fluids comprising hydrocarbon fluids and secondary fluids through said well tubing;

(c) providing a flow control valve connected to said well tubing below the surface of the well, said flow control valve being normally open to allow well fluid production therethrough, and when said flow control valve is closed, to block the upward flow of well fluids in the well tubing from below said flow control valve;

(d) providing a supply conduit having a smaller internal diameter than said well tubing to supply pressurized gas from a pressurized gas source to the well tubing, said supply conduit extending in the casing annulus of said producing well and communicating with said well tubing through a port means below flow control valve;

(e) providing a passageway connected to said well tubing, through which liquid can be forced from said well tubing into the casing annulus;

(f) providing check valve means connected to said well tubing below said passageway to prevent downward flow of secondary fluids into the hydrocarbon producing formation;

(g) monitoring the pressure differential within said well tubing during hydrocarbon fluid production to a sales line;

(h) actuating said flow control valve to its closed position when said pressure differential inside said well tubing exceeds a predetermined amount;

(i) injecting pressurized gas through said supply conduit into the well tubing below the closed closure means of said flow control valve to pressurize the fluid therein;

(j) forcing the secondary fluids from the well tubing through said passageway to the casing annulus with said pressurized gas to remove said secondary fluid from said well tubing and to displace said secondary fluids into a water bearing formation above the hydrocarbon producing formation;

(k) monitoring the reduction of differential pressure inside said well tubing due to the removal of said secondary fluid from the tubing;

(l) stopping the flow of said pressurized gas into said supply conduit to stop fluid removal when the pressure differential in said well tubing is reduced to a desired level;

(m) connecting an upper portion of said well tubing to said supply conduit to relieve the pressure inside said supply conduit into said upper portion of said well tubing;

(n) reducing the differential pressure across the closure means of said flow control valve;

(o) opening said flow control valve; and (p) opening said well tubing to surface facilities for production.

8. The method of claim 7 wherein the steps of secondary fluid removal and hydrocarbon fluid production are conducted in a regular timed sequence.

9. The method according to claim 7, wherein said secondary fluids are disposed of into a water bearing formation below said hydrocarbon producing formation through a bypass conduit extending between said well bore and said well tubing string.

10. A fluid pressure actuated flow control valve, connected to a well tubing to control fluid flow through said well tubing, comprising:

(a) a tubular housing having a bore therethrough;

(b) a valve closure member moving between open and closed positions;

(c) a longitudinal operator tube telescopically moveable in a housing bore for controlling the movement of said valve closure member;

(d) resilient urging means for biasing said operator tube in a first direction to open said valve closure member; and (e) pressure responsive means for moving said operator tube in a second direction, opposite said first direction, to close said valve closure member in response to fluid pressure transmitted to said pressure responsive means from the surface of said well through a supply conduit extending in a casing annulus.

11. The flow control valve according to claim 10, wherein said flow control valve includes an equalizing subassembly to reduce the pressure differential across the valve closure means of said flow control valve comprising;

a housing having a bore therethrough;

a flowway having its longitudinal axis within the wall of said housing, parallel to said housing bore;

a cooperable valve member and valve seat, controlling fluid flow through said flowway;

a closed-dome gas chamber in said housing said chamber being in fluid communication with said supply conduit through a port provided in said housing;

a pressure responsive member located in said flowway, exposed on one side to the pressure in said dome gas chamber to move said cooperable valve member to open and closed positions in response to changes in fluid pressure in said dome-gas chamber;

choke means in said dome-gas chamber to provide a dampening effect during valve opening by restricting fluid flow from said dome gas chamber; and means for transporting well fluid pressure past said valve closure member to said bore of said flow control valve to reduce the pressure differential across said flow control valve closure member.

12. The flow control valve according to claim 10, wherein said flow control valve includes pressure responsive means to move said operator tube to said first direction, to open said flow control valve in response to fluid pressure transmitted to said first side of said pressure responsive means through a first control conduit extending in the casing annulus between the surface of said well and said flow control valve; said pressure responsive means also moving said operator tube to said second direction, to close said flow control valve in response to fluid pressure transmitted to the second side of said pressure responsive means through a second control conduit extending in the casing annulus between the surface of said well and said flow control valve.

13. The flow control valve according to claim 10, wherein said pressure responsive means which moves said operator tube is a piston having its longitudinal axis within the wall of said housing.

14. The flow control valve according to claim 10, wherein said pressure responsive means which moves said operator tube encompasses and surrounds the diameter of said operator tube.

15. The flow control valve of claim 10 wherein the said flow control valve is wire line retrievable.

16. The flow control valve of claim 10 wherein the said flow control valve is tubing retrievable.

17. The flow control valve of claim 10 wherein the resilient urging means moving said operator tube to the open position includes a pressurized gas chamber.

18. The flow control valve according to claim 10, wherein said closure means is a ball and socket type valve.

19. The flow control valve according to claim 10, wherein said closure means is a flapper type valve.

20. A method of removing accumulated liquids from a hydrocarbon producing well having a casing with perforations at a hydrocarbon producing formation, said casing further having a string of well tubing disposed within it, the method comprising the steps of:

producing well fluids comprising hydrocarbon fluids and secondary fluids through said well tubing;

providing a flow control valve connected to said well tubing below the surface of the well, said flow control valve being normally open to allow well fluid production therethrough, and when said flow control valve is closed, to block the upward flow of fluids in the well tubing from below said flow control valve;

equalizing the pressure across a closure means of said flow control valve to assist opening of said flow control valve after it has been closed;

supplying pressurized gas from a pressurized gas source to the well tubing through a supply conduit having a smaller inner diameter than the inner diameter of said well tubing, said supply conduit extending in the casing annulus of said producing well and communicating with said well tubing through a port below said flow control valve;

sensing fluid pressure differential between at least two predetermined locations in said well tubing;

providing a passageway, connecting said well tubing to said casing annulus to allow fluid communication therethrough;

preventing the flow of said secondary fluids from said well tubing into said hydrocarbon producing formation by suitable means, such as check valves;

monitoring the pressure differential within said well tubing while said producing well is producing fluid to a sales line;

actuating said flow control valve to its closed position when said pressure differential inside said well tubing exceeds a predetermined pressure;

injecting pressurized gas through said supply conduit into said well tubing below said closed control valve to pressurize the fluid therein;

using said pressurized gas to force said secondary fluids from said well tubing through said passageway means and into said casing annulus, to remove said secondary fluids from said well tubing;

transporting said secondary fluids from said casing annulus to the surface of said well;

monitoring said pressure differential between said predetermined locations in said well tubing during removal of said secondary fluids;

stopping the flow of said pressurized gas through said supply conduit to stop removal of said secondary fluids from said well tubing when said pressure differential in said well tubing is reduced to a predetermined pressure;

connecting an upper portion of said well tubing, above said flow control, to said supply conduit to relieve the pressure inside said supply conduit to the upper portion of said well tubing;

equalizing the fluid pressure above and below said flow control valve with said equalizing means, to allow for the opening of said flow control valve;

opening said flow control valve; and producing hydrocarbon fluids through said well tubing to surface facilities.

21. A fluid-pressure actuated flow control valve adapted for connection to a well tubing to control the flow of fluid through said well tubing, comprising:

a tubular housing having a bore therethrough;

a valve closure member movable between open and closed positions;

a longitudinal operator tube telescopically moveable within said housing bore, to control the movement of said valve closure means between said open and closed positions;

resilient urging means to move said operator tube in a first direction to open said valve closure member;

pressure responsive means to move said operator tube in a second direction, opposite said first direction, to close said valve closure member in response to fluid pressure transmitted to said pressure responsive means from the surface of said well by a pressurized gas through a supply conduit extending in a casing annulus of said well;

at least one fluid injection control subassembly, contained within said control valve housing, to control the flow of pressurized gas from said supply line to said well tubing;

a fluid injection control subassembly housing, having a flowway therethrough, said flowway providing fluid communication between said supply line and said well tubing;

a cooperable valve member and valve seat, located in said flowway, to control the flow of fluid through said flowway;

a closed gas chamber in said fluid injection control subassembly housing;

a pressure responsive member, exposed on a first side to fluid pressure from said gas chamber which biases said valve member downwardly toward its seated position; said pressure responsive member being exposed on a second side to pressure in said supply line which tends to move said valve member upwardly, to unseat said valve member; and at least one check valve to prevent the flow of fluid from said well into said supply line.

22. An apparatus for attachment adjacent the end of a string of production tubing to remove liquids which have accumulated in the production tubing from the production of hydrocarbons, comprising:

valve means disposed adjacent and above the point of entry of the hydrocarbons into the production tubing for preventing the back flow from the production tubing of hydrocarbons which have entered the production tubing;

upper valve means disposed in the tubing string above said valve means for closing the flow bore of the production tubing and encapsulating the accumulated liquids in that section of the lower portion of the tubing string between the upper valve means and valve means;

gas supply means extending to said section of the tubing string and communicating with the flow bore of said section for pressurizing the flow bore within said section; and outlet means disposed in said section for allowing the flow of the accumulated liquids out of the flow bore of said section of the tubing string upon pressurization of said section by said gas supply means.

23. The apparatus of claim 22 further including pressure equalizing means attached to said section for equalizing the pressure between the flow bore of said section and the flow bore of the production tubing above said upper valve means.

24. The apparatus of claim 22 further including sensor means communicating between said section of the production tubing and the surface for determining the presence of accumulated liquids in said section.

25. The apparatus of claim 22 wherein said gas supply means includes an inlet valve means connected to said section for allowing the flow of pressurized gas into said section whereby the accumulated liquids are forced out of said section through said outlet means.

26. The apparatus of claim 22 wherein said upper valve means is biased in the open position to allow flow through the flow bore and is closed upon said gas supply means being pressurized.

27. A fluid pressure actuated flow control valve, connected to a well tubing to control fluid flow through said well tubing, comprising:

(a) a tubular housing having a bore therethrough;

(b) a valve closure member moving between open and closed positions;

(c) a longitudinal operator tube telescopingly moveable in a housing bore for controlling the movement of said valve closure member;

(d) resilient urging means for moving said operator tube in a first direction to open said valve closure member; and (e) pressure responsive means for moving said operator tube in a second direction, opposite said first direction to close said valve closure member in response to fluid pressure transmitted to said pressure responsive means from the surface of said well through a supply conduit extending in a casing annulus;

said flow control valve includes an equalizing subassembly to reduce the pressure differential across the valve closure means of said flow control valve comprising;

a housing having a bore therethrough;

a flowway having its longitudinal axis within the wall of said housing, parallel to said housing bore;

a cooperable valve member and valve seat, controlling fluid flow through said flowway;

a closed dome-gas chamber in said housing, said chamber being in fluid communication with said supply conduit through a port provided in said housing;

a pressure responsive member located in said flowway, exposed on one side to the pressure in said dome-gas chamber to move said cooperable valve member to open and closed positions in response to changes in fluid pressure in said dome-gas chamber;

choke means in said dome-gas chamber to provide a dampening effect during valve opening by restricting fluid flow from said dome gas chamber; and means for transporting well fluid pressure past said valve closure member to said bore of said flow control valve to reduce the pressure differential across said flow control valve closure member.

28. An apparatus for removing liquids which have accumulated in the production tubing from the production of hydrocarbons comprising;

(a) a tubular housing having a bore therethrough;

(b) a valve closure member moving between open and closed positions;

(c) a longitudinal operator tube telescopingly moveable in a housing bore for controlling the movement of said valve closure member;

(d) resilient urging means for moving said operator tube in a first direction to open said valve closure member;

(e) pressure responsive means for moving said operator tube in a second direction, opposite said first direction, to close said valve closure member in response to fluid pressure;

(f) valve means disposed below said valve closure member and above the point of entry of the hydrocarbons into said tubular housing for encapsulating the accumulated liquids in that portion of said tubular housing between said valve closure member and said valve means;

(g) disposal means mounted in said tubular housing for removing the accumulated liquids from said portion of said tubular housing; and (h) a pressurized fluid supply communicating with said pressure responsive means and said tubing housing portion from the surface of said well through a supply conduit; said pressurized fluid supply transmitting fluid pressure to said pressure responsive means for closing said valve closure member and to said tubing housing portion to displace the accumulated liquids through said disposal means.

29. An apparatus according to claim 28, wherein said flow control valve includes pressure responsive means to move said operator tube to said first direction, to open said flow control valve in response to fluid pressure transmitted to said first side of said pressure responsive means through a first control conduit extending in the casing annulus between the surface of said well and said flow control valve.

30. An apparatus according to claim 28, wherein said pressure responsive means which moves said operator tube is a piston having its longitudinal axis within the wall of said housing.

31. An apparatus according to claim 28, wherein said pressure responsive means which moves said operator tube encompasses and surrounds the diameter of said operator tube.

32. An apparatus according to claim 28 wherein the said flow control valve is wire line retrievable.

33. An apparatus according to claim 28 wherein the said flow control valve is tubing retrievable.

34. The apparatus according to claim 28 wherein the resilient urging means moving said operator tube to the open position includes a pressurized gas chamber.

35. The apparatus according to claim 28 wherein said closure member is a ball and socket type valve.

36. The apparatus according to claim 28 wherein said closure means is a flapper type valve.

37. An apparatus for removing liquids which have accumulated in the production tubing from the production of hydrocarbons comprising:

a tubular housing having a bore therethrough;

a valve closure member displaceably movable between an open and a closed position;

a longitudinal operator tube, telescopically movable in a housing bore for controlling the movement of said valve closure member between said open and closed position;

pressure responsive means to move said operator tube to said open position to thereby open said flow control valve;

said pressure responsive means acting in response to fluid pressure transmitted to a first side of said pressure responsive means through a first control conduit extending in a casing annulus between the surface of said well and said flow control valve;

said pressure responsive means also displacing said operator tube to said closed position to thereby close said flow control valve;

said pressure responsive means closing said flow control valve in response to fluid pressure transmitted to a second side of said pressure responsive means through a second control conduit extending in said casing annulus between the surface of said well and said flow control valve;

valve means disposed below said valve closure member and above the point of entry of the hydrocarbons and into the production tubing for encapsulating the accumulated liquids between said valve closure member and said valve means;

a relief valve deposed in said tubular housing between said valve closure member and said valve means for removing the accumulated liquids; and pressure supply means for selectively transmitting fluid pressure through said first and second control conduits and for pressurizing said tubular housing between said valve closure member and said valve means to displace the accumulated liquids through said relief valve.

38. A method of removing accumulated liquids from a hydrocarbon producing well comprising:

(a) sealing off a hydrocarbon producing formation from a water bearing formation;

(b) producing well fluids comprising hydrocarbon fluids and secondary fluids through a string of well tubing communicating with the hydrocarbon producing formation and having a valve means in said tubing to prevent downward flow of fluids and a flow control valve above said valve means;

(c) monitoring the pressure differential within said well tubing during hydrocarbon fluid production;

(d) actuating said flow control valve to its closed position when said pressure differential inside said well tubing exceeds a predetermined amount and (e) injecting pressurized gas through a supply conduit into said well tubing below said closed flow control valve to pressurize the fluid and force the fluid through a to pressurize the fluid and force the fluid through a valved passageway in said tubing and into the annulus between said tubing and said water bearing formation.

* * * * *

UNITED STATES PATENT AND TRADEMARK OFFICE

CERTIFICATE OF CORRECTION

PATENT NO. : 4,791,990

DATED : December 20, 1988

INVENTOR(S) : Mahmood Amani

It is certified that error appears in the above—identified patent and that said Letters Patent is hereby corrected as shown below:

Column 1, line 3, after "Producing", insert -- Wells --.

Column 24, lines 55 and 56, delete "and force the fluid through a to pressurize the fluid".

Signed and Sealed this

Sixth Day of February, 1990

*Attest:*

JEFFREY M. SAMUELS

*Attesting Officer*

*Acting Commissioner of Patents and Trademarks*